US007267568B2

(12) United States Patent
Baker

(10) Patent No.: US 7,267,568 B2
(45) Date of Patent: Sep. 11, 2007

(54) FLOATING CONNECTORS

(75) Inventor: John W. Baker, Hudson, MA (US)

(73) Assignee: Bigband Networks BAS, Inc., Redwood City, CA (US)

( * ) Notice: Subject to any disclaimer, the term of this patent is extended or adjusted under 35 U.S.C. 154(b) by 336 days.

(21) Appl. No.: 10/828,722

(22) Filed: Apr. 21, 2004

(65) Prior Publication Data

US 2005/0239310 A1 Oct. 27, 2005

(51) Int. Cl.
*H01R 13/64* (2006.01)

(52) U.S. Cl. ..... 439/247

(58) Field of Classification Search ..... 439/246–247, 439/378, 571–573
See application file for complete search history.

(56) References Cited

U.S. PATENT DOCUMENTS 3,951,500 A * 4/1976 Anderson ..... 439/248
4,277,126 A * 7/1981 Lincoln ..... 439/681
4,842,543 A * 6/1989 Davis ..... 439/378
5,228,865 A * 7/1993 Douty et al. ..... 439/247
5,391,091 A * 2/1995 Nations ..... 439/378
5,622,511 A * 4/1997 Jarrett ..... 439/248
5,647,758 A * 7/1997 Ichikawa et al. ..... 439/362
5,993,241 A * 11/1999 Olson et al. ..... 439/378
6,030,242 A * 2/2000 Cunningham et al. ..... 439/247
6,142,814 A * 11/2000 Wu et al. ..... 439/378
6,217,368 B1 * 4/2001 Baron et al. ..... 439/378
6,234,817 B1 * 5/2001 Hwang ..... 439/247
6,322,382 B1 * 11/2001 Viallet ..... 439/248
6,346,007 B2 * 2/2002 Yokoi ..... 439/564
6,358,075 B1 * 3/2002 Tischner ..... 439/248
6,406,192 B1 * 6/2002 Chen et al. ..... 385/56
6,422,892 B1 * 7/2002 Chen et al. ..... 439/378
6,435,891 B1 * 8/2002 Beck et al. ..... 439/248
6,494,735 B1 * 12/2002 Chen et al. ..... 439/378
6,520,791 B2 * 2/2003 Burger ..... 439/362
6,527,572 B2 * 3/2003 Jou ..... 439/248
6,592,387 B2 * 7/2003 Komenda et al. ..... 439/247
6,736,659 B1 * 5/2004 Wu ..... 439/247
6,773,286 B1 * 8/2004 Wu ..... 439/247
6,802,734 B2 * 10/2004 Wu ..... 439/362
6,824,419 B1 * 11/2004 Wu ..... 439/378
6,843,674 B1 * 1/2005 Young ..... 439/248
6,890,200 B1 * 5/2005 Wu ..... 439/247
6,923,679 B1 * 8/2005 Wu ..... 439/573
6,927,974 B2 * 8/2005 Robillard et al. ..... 361/686
6,945,816 B1 * 9/2005 Wu ..... 439/545

(Continued)

*Primary Examiner*—Ross Gushi
(74) *Attorney, Agent, or Firm*—Sonnenschein Nath & Rosenthal LLP

(57) ABSTRACT

Apparatus including a first edge having a cutout adjacently located between a pair of counter bore panels, a connector assembly including a connector having a mounting flange with a pair of inserts and a pair of guide pins. The pair of inserts adapted to receive and secure the pair of guide pins. Mounting flange adapted to abut a rear face of the first edge such that the connector extends through the cutout and the pair of inserts align with the pair of counter bore panels. The cutout and the pair of counter bore panels are slightly oversized for the connector and respective guide pins. Once the pair of guide pins is received by the pair of inserts the connector floats within a space defined by the cutout and pair of counter bore panels and the connector and pair of guide pins.

20 Claims, 2 Drawing Sheets

U.S. PATENT DOCUMENTS

| | | | | |
|---|---|---|---|---|
| 6,994,577 | B2 * | 2/2006 | Margulis et al. | 439/247 |
| 2001/0002344 | A1 * | 5/2001 | Yokoi | 439/247 |
| 2002/0048982 | A1 * | 4/2002 | Gu et al. | 439/247 |
| 2003/0077932 | A1 * | 4/2003 | Lewinnek | 439/246 |
| 2003/0171029 | A1 * | 9/2003 | Yamada et al. | 439/553 |
| 2005/0176291 | A1 * | 8/2005 | Wu | 439/573 |
| 2005/0239310 | A1 * | 10/2005 | Baker | 439/247 |
| 2005/0245113 | A1 * | 11/2005 | DeSilva et al. | 439/140 |
| 2005/0282421 | A1 * | 12/2005 | Margulis et al. | 439/247 |
| 2006/0035500 | A1 * | 2/2006 | Sugita et al. | 439/247 |
| 2006/0063411 | A1 * | 3/2006 | Kim et al. | 439/247 |
| 2006/0079112 | A1 * | 4/2006 | Shuey et al. | 439/374 |
| 2006/0105603 | A1 * | 5/2006 | Nishio et al. | 439/247 |

* cited by examiner

FLOATING CONNECTORS

TECHNICAL FIELD

The following description relates to connectors and in particular to connector interfaces.

BACKGROUND

Many electronics equipment includes circuit cards. Often the circuit cards are designed to be inserted into a chassis, shelf or other equipment. The circuit cards typically include connectors for connection to the housing or other equipment within the housing or connected to the housing, such as a backplane. With the variation in card sizes and tolerances, it is often difficult to align connectors on the cards with associated connectors on a backplane or adapter card. In particular, when the card includes more than one connector to be aligned. This results in poor connection, lack of connection, or on-site modifications to the connectors either on the backplane, adapter card, or the circuit card. On-site modifications can lead to additional problems, such as loose connections to the cards, damage to other circuitry on the card, and modified cards that are non-standard.

There is a need for flexibility between the connectors on the card and associated connectors on the backplane or other equipment.

SUMMARY

In one embodiment, an apparatus includes, a first edge having a cutout adjacently located between a pair of counter bore panels and a connector assembly. The connector assembly includes a connector having a mounting flange including a pair of inserts, a pair of spacer bushings sized to be received by the pair of counter bore panels and a pair of guide pins. The pair of inserts are adapted to receive and secure the pair of guide pins via the pair of counter bore panels. The mounting flange is adapted to abut a rear face of the first edge such that the connector extends through the cutout and the pair of inserts align with the pair of counter bore panels. The cutout and the pair of counter bore panels are slightly oversized for the connector and respective guide pins such that once the pair of guide pins is received by the pair of inserts, the connector floats within a space defined by the cutout and pair of counter bore panels and the connector and pair of guide pins, respectively.

In another embodiment a backplane includes a rear panel including one or more cutouts, each cutout adjacently located between a pair of counter bore panels, a connector having a mounting flange, wherein the mounting flange includes a pair of threaded inserts and a pair of guide pins, each guide pin having one threaded end. The mounting flange is adapted to abut the rear panel such that the connector extends through the cutout and the threaded inserts align with the pair of counter bore panels. The threaded inserts are adapted to receive and secure the pair of guide pins via the pair of counter-bore panels. The cutout and the pair of counter bore panels are slightly oversized for the connector and respective guide pins such that once the pair of guide pins is received by the pair of threaded inserts, the connector floats within a tolerance defined by the oversize of the cutout and pair of counter bore panels in relation to the connector and pair of guide pins.

The details of one or more embodiments of the claimed invention are set forth in the accompanying drawings and the description below. Other features and advantages will become apparent from the description, the drawings, and the claims.

DRAWINGS

DETAILED DESCRIPTION

Embodiments of the present invention provide systems and methods of a floating connector. The floating connector allows for variations in tolerance.

Figure 1:
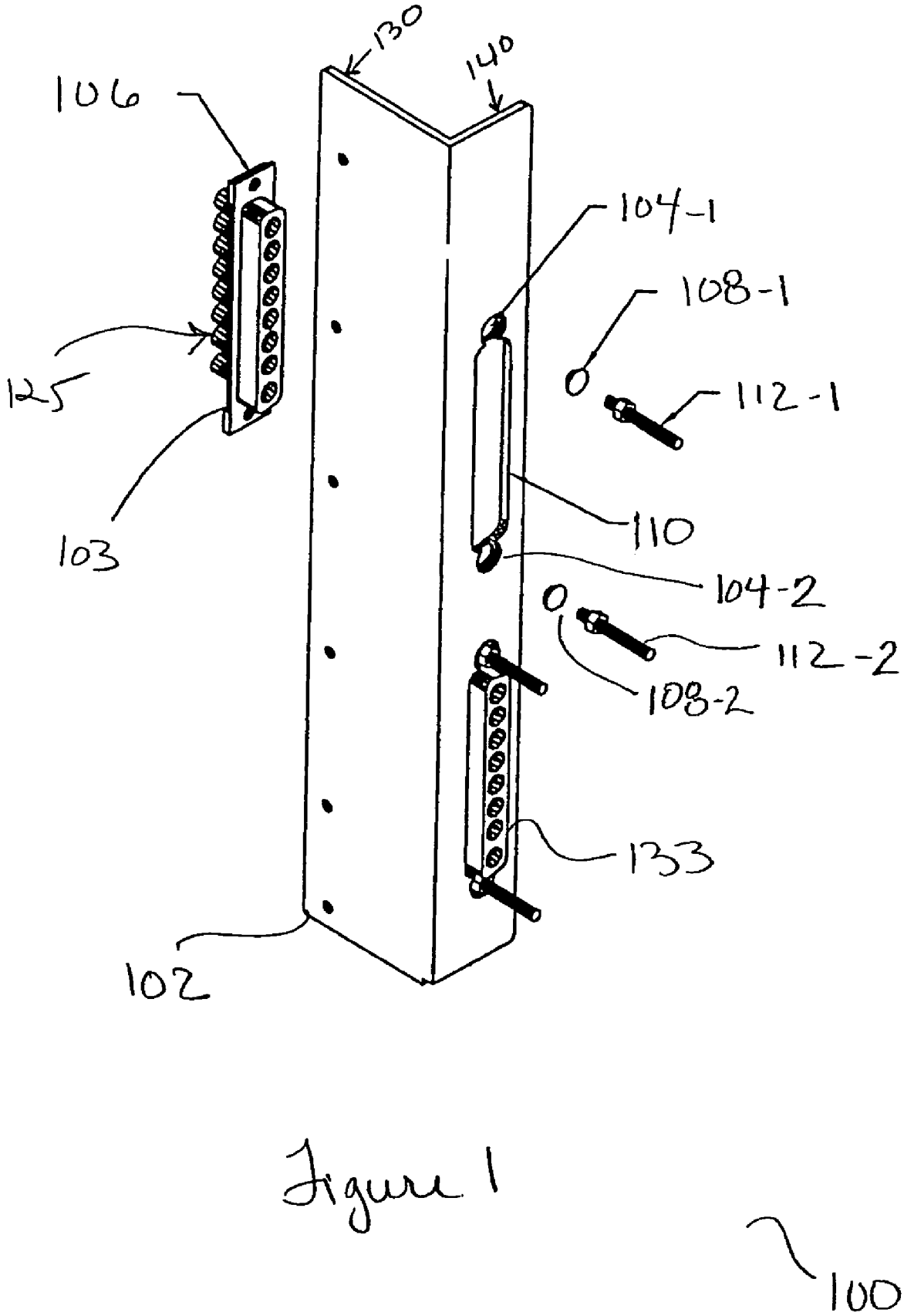
FIG. 1 is a block diagram of one embodiment of an apparatus including a floating connector assembly according to the present invention.

FIG. 1 is an illustration of one embodiment of an apparatus having two floating connectors, shown generally at 100, according to the teachings of the present invention. Apparatus 100 includes an angle support bracket 102 having a first edge 130 and a second edge 140. In one embodiment, first edge 130 and second edge 140 are at right angles to one another. In another embodiment, apparatus 100 only includes a single edge 140.

On a surface of second edge 140 there is a cutout 110 adapted to receive a connector such as coaxial connector 125 and interface with flange 103 of connector 125. Cutout 110 is sized for the particular connector and meets required tolerance standards. Cutout 110 is adjacent to first and second counter-bore panels 104-1 and 104-2. Counter-bore panels 104-1 and 104-2 are each adapted to receive and secure spacer bushings 108-1 and 108-2, respectively. In one embodiment, counter-bore panels 104-1 and 104-2 are adapted to receive spacer bushings 108-1 and 108-2, respectively.

Flange 103 of connector 125 abuts the back surface of edge 140 and threaded inserts 106-1 and 106-2 align with counter bore-panels 108-1 and 108-2, respectively. Spacer bushings 108-1 and 108-2 are adapted to interface with guide pins 112-1 and 112-2. In one embodiment, threaded inserts 106-1 and 106-2 are each internally threaded to receive and secure guide pins 112-1 and 112-2, respectively. In this embodiment, guide pins 112-1 and 112-2 are partially externally threaded. In other embodiments, threaded inserts 106-1 and 106-2 are adapted to receive and secure guide pins 112-1 and 112-2, respectively, using a snap in or lock in feature, or another means of receiving and securing. For example, in one embodiment, guide pins 112 include a groove that engages with an edge or lip of inserts 106-1 and 106-2. The receiving and securing feature is not meant to be limiting in nature.

In operation, once connector 125 is connected to angle bracket 102 via guide pins 112-1 and 112-2 spacer bushings 108-1 and 108-2 the assembled connector "floats" within the tolerance of oversized cutout 110 and counter-bore panels 104-1 and 104-2. Oversized cutout 110 is oversized in relation to the size of connector 123. An example of an assembled connector is connector 133. Once assembled, connector 125 is able to move in any direction along the plane created by edge 140 within a defined tolerance of oversized cutout 110 and counter-bore panels 104. The defined tolerance is constrained by the size of cutout 110 in relation to connector 125 and the dimensions of counter bore panels 104-1 and 104-2 with respect to spacer bushings 108-1 and 108-2, respectively.

Figure 2:
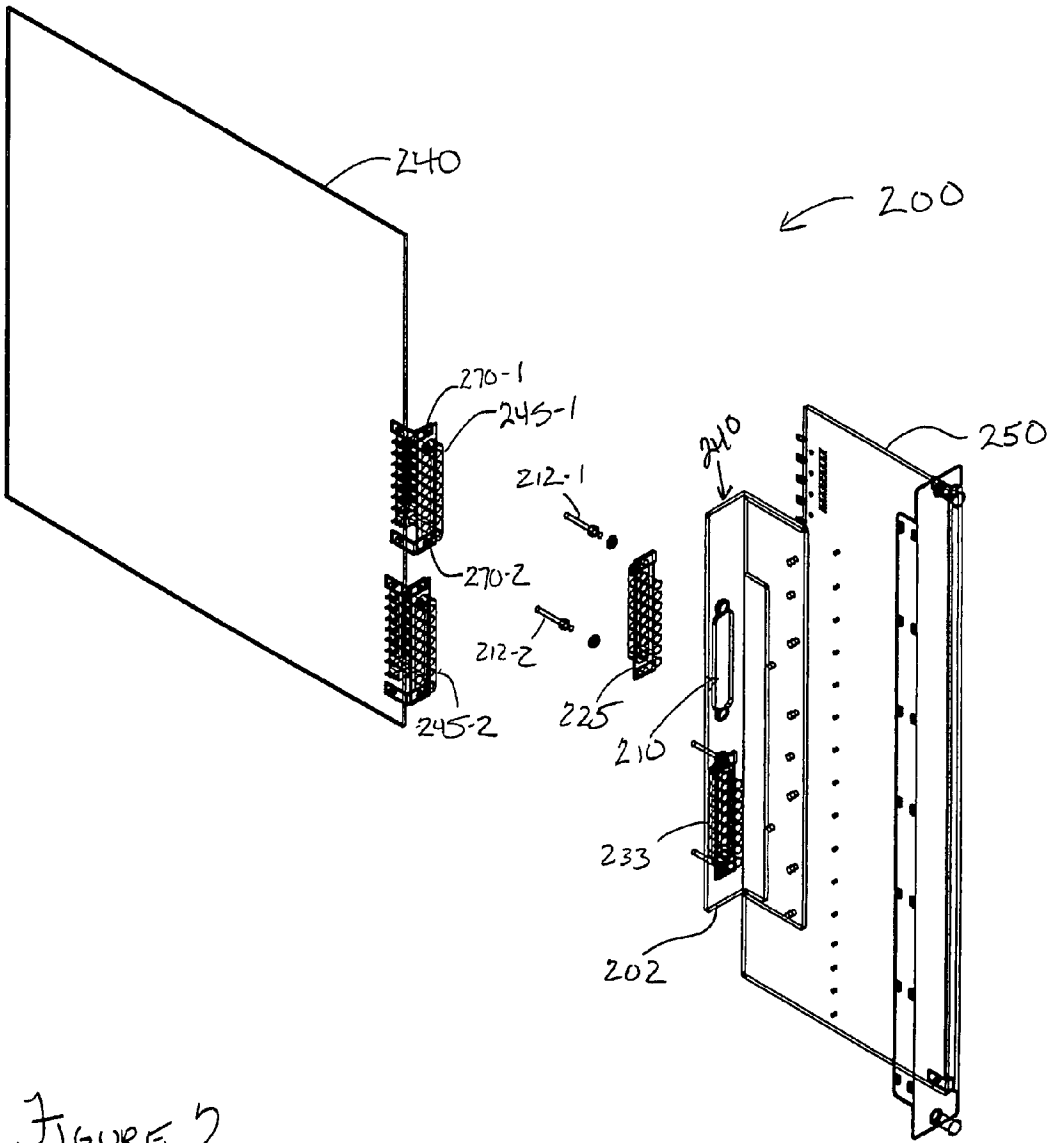
FIG. 2 is a block diagram of one embodiment of a connector system including floating connectors according to the present invention.

In one embodiment, mating connectors as discussed below with respect to FIG. 2 are mounted on a circuit card or other electronic device or equipment. The mating connectors include sockets adapted to receive guide pins 112-1 and 112-2 and align connector 125 (assembled) and assembled connector 133 with respective mating connectors. This results in a positive connection as well as eases the interface of the circuit card or equipment with apparatus 100.

It is understood that although apparatus 100 is shown as an angle bracket 102 having a first edge 130 and a second edge 140 that are at right angles to each other, apparatus 100 can be a single piece of material without an angle edge or have multiple edges at any angle to one another. In other embodiments, apparatus 100 comprises openings such as opening 110 in any piece of material or equipment. E.g. a side of housing, a mounting panel, a backplane adapted to receive multiple connectors or the like. In one embodiment, connectors 125 and 133 are mounted on a backplane.

FIG. 2 is an illustration of one embodiment of a connector system including floating connectors, shown generally at 200, according to the teachings of the present invention. System 200 includes a circuit board 240 having two mating connectors 245-1 and 245-2 and an interface 250 including a pair of floating connectors 225 and 233. In on embodiment, interface 250 is an extension of angle support bracket 202 and extends between a mounting panel, backplane, or the like (not shown) and angle support bracket 202. Interface 250 may be any size or shape to fit a specific application and in some instances is not necessary.

In one embodiment circuit board 240 is a printed circuit board and is adapted to mate with floating connectors 225 and 233 via mating connectors 245-1 and 245-2, respectively. In this embodiment, mating connectors 245-1 and 245-2 are mounted on circuit board 240 and each connector 245-1 and 245-2 includes a pair of receptacles 270-1 and 270-2 that are adapted to receive guide pins 212-1 and 212-2, respectively. Guide pins 212-1 and 212-2 are physically attached to connector 225 and once assembled onto angle bracket 202 assembled connector 225 floats within oversized cutout 210. Assembled connector 225's ability to float within oversized cutout 210 enables connector 225 to be easily mated with mating connector 245-1. Guide pins 212-1 and 212-2 align with receptacles 245-1 and 245-2, respectively and once aligned receptacles 245-1 and 245-2 receive guide pins 212-1 and 212-2. As a result connectors 225 and 245-1 are then properly aligned for mating.

The use of guide pins and receptacles that are integrated with respective connectors significantly aids in the ease of connection between mating connectors. Further the ability for connectors 225 and 233 to float along a plane defined by edge 240, of angle bracket 202, further aids in the ease of mating connectors 225, 233 with 245-1 and 245-2, respectively. For example connectors 245-1 and 245-2 may be aligned at the largest tolerated distance between the connectors and mating connectors 225 and 233 are capable of adjusting to the proper spacing. In this instance connector 225 would shift upward along edge 240 and connector would shift downward along edge 240. In another embodiment, connector 225 may be aligned without shifting in any direction but connector 245 shifts along edge 240 as required.

It is understood that in other embodiments mating connectors such as mating connectors 245-1 and 245-2 may be mounted on electronic equipment or devices, interfaces or the like.

It will be appreciated by those skilled in the art, with the benefit of the present description, that the apparatus can include one or more floating connector assemblies. The description has been simplified to better understand the present invention. In addition, the present invention can be implemented in any equipment employing connectors.

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

What is claimed is:

1. An apparatus, comprising:

a first edge having a cutout adjacently located between a pair of counter bore panels; and a connector assembly, including;

a connector having a mounting flange including a pair of inserts;

a pair of spacer bushings sized to be received by the pair of counter bore panels; and a pair of guide pins;

wherein the pair of inserts are adapted to receive and secure the pair of guide pins via the pair of counter bore panels;

wherein the mounting flange is adapted to abut a rear face of the first edge such that the connector extends through the cutout and the pair of inserts align with the pair of counter bore panels;

wherein the cutout and the pair of counter bore panels are slightly oversized for the connector and respective guide pins such that once the pair of guide pins is received by the pair of inserts, the connector floats within a space defined by the cutout and pair of counter bore panels and the connector and pair of guide pins, respectively.

2. The apparatus of claim 1, wherein the pair of inserts are threaded inserts.

3. The apparatus of claim 2, wherein one end of each of the pair of guide pins are externally threaded.

4. The apparatus of claim 1, wherein the connector is a coaxial connector.

5. The apparatus of claim 1, wherein the connector is adapted to couple with a mating connector having receptacles to receive the pair of guide pins.

6. A backplane, comprising:

a rear panel including one or more cutouts, each cutout adjacently located between a pair of counter bore panels;

a connector having a mounting flange, wherein the mounting flange includes a pair of threaded inserts; and wherein the mounting flange is adapted to abut the rear panel such that the connector extends through the cutout and the threaded inserts align with the pair of counter bore panels;

a pair of guide pins, each guide pin having one threaded end, wherein the threaded inserts are adapted to receive and secure the pair of guide pins via the pair of counter-bore panels;

wherein the cutout and the pair of counter bore panels are slightly oversized for the connector and respective guide pins such that once the pair of guide pins is received by the pair of threaded inserts, the connector floats within a tolerance defined by the oversize of the cutout and pair of counter bore panels in relation to the connector and pair of guide pins.

7. The backplane of claim 6, wherein the connector is adapted to couple with a mating connector having receptacles to receive the pair of guide pins.

8. A connector system, comprising:

one or more mating connectors coupled to a printed circuit board;

wherein each mating connector includes a pair of receptacles;

a mounting panel including a first edge having one or more oversized cutouts, wherein each oversized cutout is adjacently located between a pair of counter bore panels; and one or more floating connector assemblies, each floating connector assembly including:

a first connector having a mounting flange including a pair of inserts;

a pair of spacer bushings sized to be received by the pair of counter bore panels; and a pair of guide pins;

wherein the pair of inserts are adapted to receive and secure the pair of guide pins via the pair of counter bore panels;

wherein the mounting flange is adapted to abut a rear face of the first edge such that the first connector extends through the cutout and the pair of inserts align with the pair of counter bore panels;

wherein a first oversized cutout of the one or more oversized cutouts and a respective pair of counter bore panels are slightly oversized for the first connector and respective pair of guide pins such that once the pair of guide pins is received by the pair of inserts, the first connector floats within a space defined by the cutout and pair of counter bore panels and the first connector and pair of guide pins, respectively;

wherein each of the one or more mating connectors is adapted to couple with one of the one or more floating connector assemblies.

9. The system of claim 8, wherein the pair of receptacles of the one or mating connectors is adapted to receive a corresponding pair of guide pins of the one or more floating connector assemblies.

10. The system of claim 9, wherein the one or more floating connector assemblies moves within the defined space to align with the respective one or more mating connectors.

11. The system of claim 8, wherein the mounting panel is a backplane.

12. The system of claim 9, wherein the one or more floating connector assemblies moves horizontally within the defined space to align with the respective one or more mating connectors.

13. The system of claim 9, wherein the one or more floating connector assemblies moves vertically within the defined space to align with the respective one or more mating connectors.

14. The system of claim 9, wherein the one or more floating connector assemblies moves vertically and horizontally within the defined space to align with the respective one or more mating connectors.

15. A backplane, comprising:

a rear panel including one or more cutouts, each cutout adjacently located between a pair of counter bore panels;

a connector having a mounting flange, wherein the mounting flange includes a pair of inserts; and wherein the mounting flange is adapted to abut the rear panel such that the connector extends through the cutout and the inserts align with the pair of counter bore panels;

a pair of guide pins, wherein the pair of inserts are adapted to receive and secure the pair of guide pins via the pair of counter-bore panels;

wherein the cutout and the pair of counter bore panels are slightly oversized for the connector and respective guide pins such that the connector floats within a tolerance defined by the oversize of the cutout and pair of counter bore panels in relation to the connector and pair of guide pins.

16. The backplane of claim 15, wherein the pair of inserts are threaded inserts.

17. The backplane of claim 16, wherein one end of each of the pair of guide pins are externally threaded.

18. The backplane of claim 15, wherein the connector moves horizontally within the defined space to align with the respective one or more mating connectors.

19. The backplane of claim 15, wherein the connector moves moves vertically within the defined space to align with the respective one or more mating connectors.

20. The backplane of claim 15, wherein the connector moves vertically and horizontally within the defined space to align with the respective one or more mating connectors.

* * * * *